United States Patent [19]

Garcéa

[11] 3,963,808

[45] June 15, 1976

[54] CARBURETORS FOR INTERNAL COMBUSTION ENGINES

[75] Inventor: Giampaolo Garcéa, Milan, Italy

[73] Assignee: Alfa Romeo S.p.A., Milan, Italy

[22] Filed: Dec. 13, 1973

[21] Appl. No.: 424,608

[30] Foreign Application Priority Data

Dec. 15, 1972 Italy ..... 33018/72

[52] U.S. Cl. ..... 261/41 D; 261/121 A

[51] Int. Cl.[2] ..... F02M 3/00

[58] Field of Search ..... 261/41 D, 121 A

[56] References Cited

UNITED STATES PATENTS

| | | | |
|---|---|---|---|
| 3,283,751 | 11/1966 | Goossak et al. | 261/41 D |
| 3,382,856 | 5/1968 | McIlroy | 261/41 D |
| 3,533,386 | 10/1970 | Masaki et al. | 261/41 D |
| 3,711,069 | 1/1973 | Hideg et al. | 261/41 D |

FOREIGN PATENTS OR APPLICATIONS

| | | | |
|---|---|---|---|
| 1,217,948 | 1/1971 | United Kingdom | 261/41 D |

*Primary Examiner*—Tim R. Miles

*Attorney, Agent, or Firm*—Haseltine, Lake & Waters

[57] ABSTRACT

To improve the operation of an internal combustion engine under idling conditions, a carburetor has at least a premixture chamber commmunicating through calibrated ports with a fuel induction duct and with a cavity: the latter communicates with the atmosphere through a calibrated port and with the intake duct through at least a progression passageway. The progression passageway opens in the vicinity of the throttle edge so that it is upstream of the edge when the throttle is in the minimum opening position and is, conversely, downstream of the edge when the throttle is partially open. An auxiliary duct is also provided for connecting the premixture chamber with the intake duct downstream of the carburetor.

2 Claims, 4 Drawing Figures

CARBURETORS FOR INTERNAL COMBUSTION ENGINES

Figure 1:
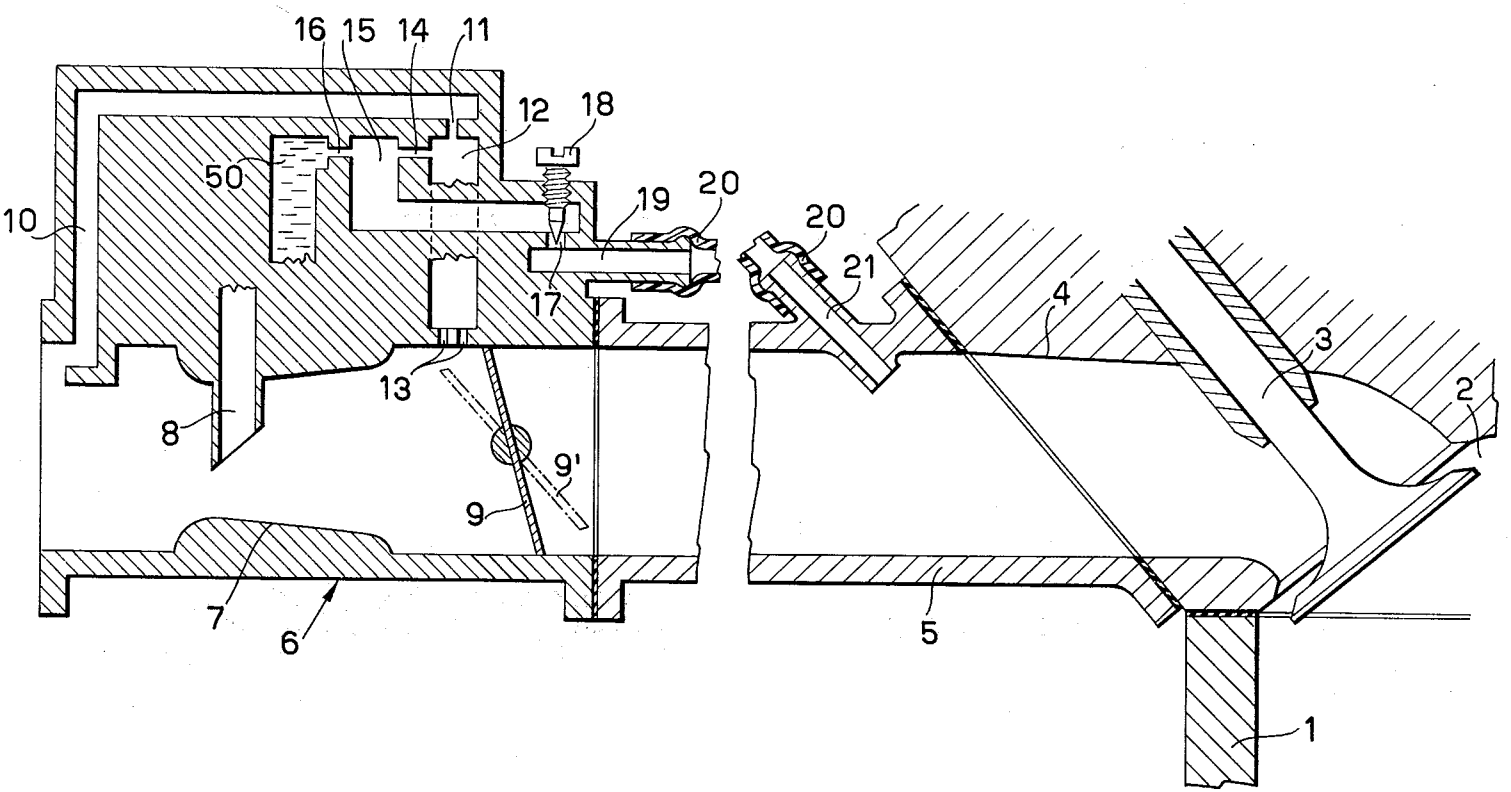

This invention relates to carburetors for internal combustion engines, more particularly to the devices which, in carburetors, effect the dispersion of the fuel in the feeding air, when the engine is idling, or is in the transitional conditions between idling and normal RPM.

As a matter of fact it is known that in the conventional carburetors different devices are adopted for introducing the fuel into the air, consistently with the rate of flow of the air drawn by the engine, or, as an alternative, as a function of the power the engine is requested to deliver.

In general, thus, a carburetor comprises a principal device which delivers in correspondence of the minimum cross-section of a converging-diverging passageway, that is a Venturi, where the fuel, together with a small rate of flow of a premixture air, is drawn by the negative pressure and is dispersed in the airstream which is caused to flow through the Venturi. The Venturi is arranged downstream of the butterfly valve which throttles the flow of the mixture as drawn by the engine.

The main device, adapted to deliver considerable amounts of fuel, as required for the operation at average and high power rates of the engine, is not adapted to pulverize in a correct manner small or very small rates of flow, such as required at the engine idling or under conditions close thereto.

Thus, for these reasons in the carburetor in addition to the main device there is provided as usual an idling device, which provides to introduce atomized fuel also in this case together with a small rate of flow of premixture air in the intake duct immediately downstream of the throttling butterfly, where a considerable negative pressure obtains when the throttle is closed or nearly so.

In the conventional carburetors there is provided, with advantage, an additional device, called a progression device, which comprises additional passageways for the fuel, which open into the intake duct in the vicinity of the butterfly edge, when the latter is approaching its closed position: more exactly these passageways are arranged downstream of the butterfly valve when the latter is in the idling position; during the rotation of the throttle, they are downstream thereof, that is, where the negative pressure is comparatively high, so that the fuel is drawn through said passageways. This expedient prevents a discontinuity of the engine feed when the throttle is opened from its idling position but the airstream running through the Venturi is not yet such as to actuate the main device.

The conventional systems, as recalled above, provide to introducing the atomized fuel in a well defined area of the engine intake duct, that is, in the vicinity of the throttling butterfly, so that serious drawbacks are originated in the operation of the engine.

The intake duct is thus so dimensioned as to allow, with minimum pressure drops, the flow of considerable amounts of mixture, such as required by the engine when the latter delivers a high power. Such a duct is inappropriate to convey the mixture flow to feed the engine which is idling, or which is running at a slightly quicker RPM. As a matter of fact the speed of the mixture is too small for an adequate turbulence of the flow to occur for maintaining in suspension the cloud of atomized petrol given by the jets: especially in a cold engine a not negligible amount of petrol is condensed on the duct walls, so that the mixture becomes leaner and the liquid deposits reach the engine in spurts, and the engine operates irregularly when idling and at a low power: the result is also an increase of unburned fraction in the exhaust gases.

No special difficulties are encountered in feeding the premixture when the engine is idling, to the duct in the vicinity of the induction valve, with a separate piping which is correctly sized for the small rates of flow of the idling run: however, this approach is unsatisfactory if one considers that the problem is still left unsolved of the conventional progression jets for which such a solution cannot be adopted, inasmuch as they are controlled by the movement of the throttle and deliver the premixture in correspondence with the throttle edge.

An object of the present invention is to make an introduction of the premixture possible downstream of the carburetor in the intake duct, both when the engine is idling under no load conditions, and when the premixture is delivered by the progression device; stated otherwise the object of the invention is to introduce the atomized petrol downstream of the carburetor until the opening of the throttle is not such as to have the conventional main jet to enter operation.

According to the invention, the introduction of the premixture for feeding the engine at the idling RPM or at the transition RPM between idling and normal run, is obtained by providing in the carburetor at least a premixing chamber which is in communication, through calibrated ports, with a fuel induction duct and with a cavity which, in turn, communicates with the outside atmosphere through a calibrated port and with the intake duct through at least a progression passageway which opens in the vicinity of the edge of said throttle, so as to be upstream of the edge when the throttle is in the minimum opening position, and downstream of the edge when the throttle is partially open; said premixing chamber is then connected by an auxiliary duct to said intake duct downstream of said carburetor.

In this way a premixture intake is obtained, which is adequate to feed the engine when it is idling or is in the transitional state between idling and the normal run: the premixture can be directed to any appropriate point of the intake duct, more particularly close to the induction valves of the engine so as to offset the drawbacks of the condensation as outlined above.

In order that the essential principles of the invention may become fully apparent, will be described hereinafter a few exemplary embodiments of carburation apparatus of internal combustion engines as illustrated in the accompanying drawings, wherein:

FIG. 1 diagrammatically shows a carburetor which incorporates according to the invention intake means for the premixture under idling conditions and progression conditions in the intake duct of an internal combustion engine of conventional make.

Figure 2:
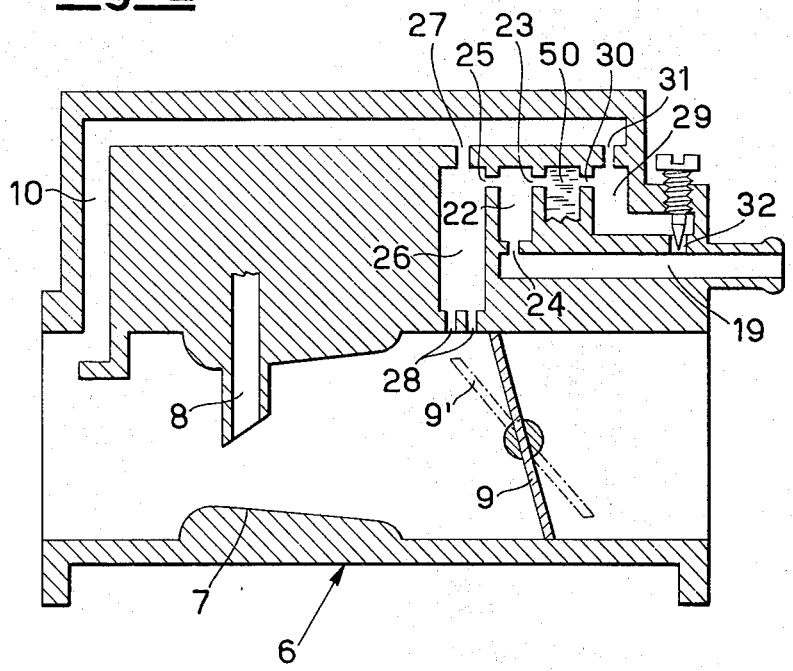
Figure 3:
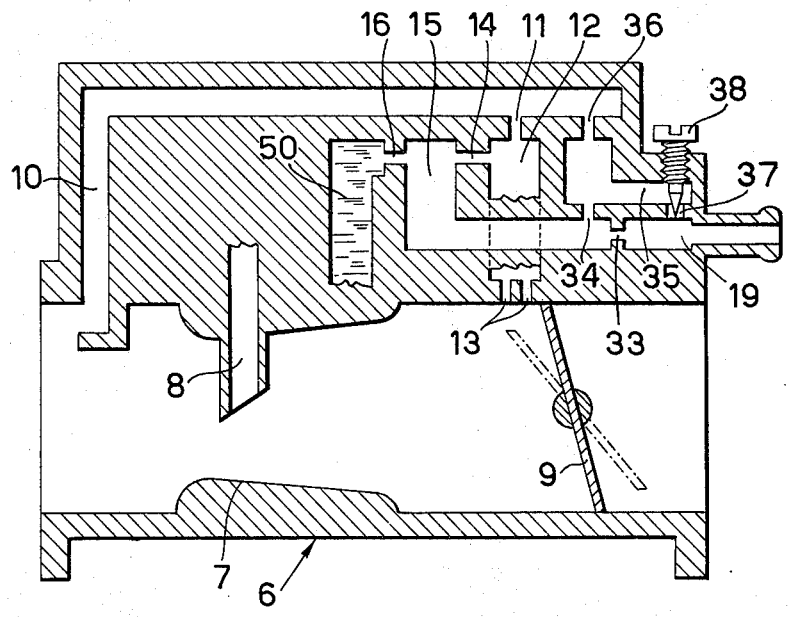
Figure 4:
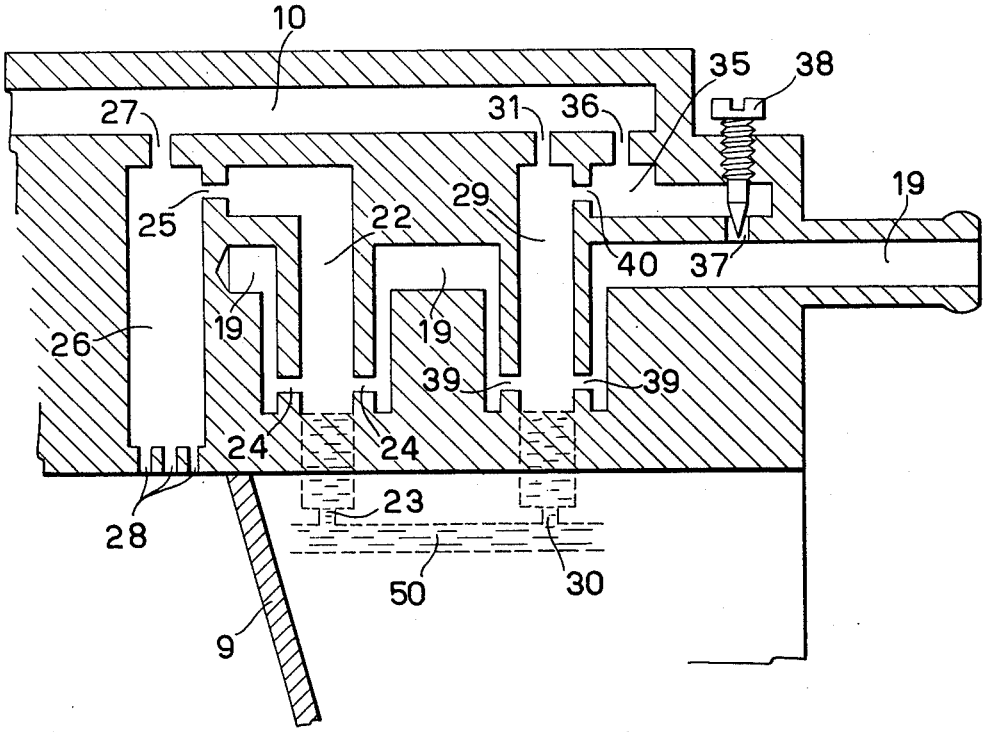

FIGS. 2, 3 and 4 show functional diagrams of alternative embodiments of the carburetor illustrated in FIG. 1.

FIG. 1 shows a cylinder 1 of an internal combustion engine known per se, in whose explosion chamber 2 opens the induction valve 3; the duct 4 of induction in the cylinder 1, formed through the engine head, receives the flow of mixture as drawn by the duct 5 flangedly connected to the engine, which extends in the section as generally indicated at 6 and formed through the carburetor body.

In correspondence with the portion 6 there is arranged along the duct a Venturi 7 in which opens the jet 8 of the mixture of the principal jet, which brings atomized fuel in the conventional way; the duct 6 is throttled by a butterfly valve 9, as mounted for rotation on the duct walls and driven to rotation by means not shown which are linked to manipulation means such as the accelerator pedal.

There is indicated at 10 a duct stemming from the duct 6, which feeds with air the chamber 12 through a calibrated hole 11; there are shown at 13 the calibrated ports which establish a communication between the pre-chamber 12 and the duct 6 in the vicinity of the butterfly 9, and there is shown at 14 the calibrated hole which opens into the chamber 15 where the petrol is delivered by the jet 16, communicating with the duct 50, the latter leading to a conventional float chamber (not shown).

The chamber 15 communicates with the duct 19 through the port 17, whose cross-sectional area can be calibrated by the action of the conical-tip screw 18; a flexible pipe 20 connects the duct 19 with a duct 21 opening into the intake duct 5 in the vicinity of the induction valve 3.

The operation of the carburetor shown in FIG. 1 is now described in summary hereinafter.

With the throttle 9 in the idling position, the pre-chamber 12 receives air from the outside both through the hole 11 communicating with the carburetor inlet and through the calibrated holes 13 which communicate with the duct 6 near the throttle, upstream thereof; from the pre-chamber 12 the air is drawn through the hole 14 into the emulsion chamber 15. Under these conditions the negative pressure obtaining in the pre-chamber 12, with respect to the outside pressure, is obviously small; consequently the negative pressure in the emulsion chamber 15 is also kept small, the pre-chamber feeding the emulsion chamber. Thus is also small the rate of flow of petrol (proportionally metered consistently to the idling operation of the engine) as drawn through the jet 16 due to the action of the negative pressure in the emulsion chamber 15.

When the throttle is partially open, that is, in the position shown at 9', the pre-chamber 12 is fed with outside air only through the hole 11 communicating with the carburetor inlet; from the pre-chamber the air is drawn not only through the hole 14 in communication with the emulsion chamber 15, but also through the ports 13 which communicate with the duct 6 in the vicinity of the throttle, said ports being downstream of the throttle. Under these conditions the negative pressure in the pre-chamber 12 with respect to the external pressure is much higher than in the case of a closed throttle. Consequently, the negative pressure is also much higher in the emulsion chamber and thus the rate of flow of petrol is higher, as drawn through the jet 16 due to the effect of the negative pressure in the emulsion chamber and such a rate of flow is enough appropriately to enrich the flow of air flowing through the ducts 6 and 5. It should be noticed that if the throttle is only partially open, the slight flow of air controlled thereby is insufficient to draw petrol through the main jet 8: this operative condition is the one which has been defined as "progression".

It should be noticed that, with the arrangement of parts according to the invention, the premixture both for idling and for progression operation of the engine, can be conveyed to a discrete duct 19, 20, 21 so as to be able to be introduced in the most appropriate position of the intake duct. Under no feeding conditions, in fact, do the ports 13 of progression deliver fuel.

In FIG. 2 there is diagrammatically shown an alternative version of a carburetor according to the invention, which provides for two discrete emulsion chambers, one for supplying and metering the premixture for feeding the idling engine, and the other for delivering the premixture to feed the engine when in its progression run.

The component parts of the carburetor shown in FIG. 2 which are similar to parts of the carburetor shown in FIG. 1 are indicated with the same reference numerals: the emulsion chamber 22 for the progression run has a calibrated hole 23 for the intake of fuel coming from the duct 50 and a calibrated hole 24 for feeding the premixture to the duct 19. The chamber 22 is fed through a calibrated hole 25 with air coming from the pre-chamber 26. The pre-chamber 26 has a hole 27 for inducing air drawn upstream of the carburetor through the duct 10 and can receive air also from the calibrated holes 28 which communicate with the duct 6 close to the edge of the throttle 9 and are arranged so as to be located upstream of the throttle edge when the throttle is in its minimum-opening position, and downstream of the throttle when the latter is in its ajar position as indicated at 9'. The "idling" premixture is formed in the emulsion chamber 29 where open the petrol jet 30, also communicating with the duct 50, and the calibrated hole 31 for the induction of air. The premixture is delivered through the variable cross-section port 32 in the duct 19; to this duct are thus delivered both the idling premixture and the progression premixture to be fed to the intake duct of the engine, in the vicinity of the induction valve as shown in FIG. 1.

FIG. 3 shows yet another embodiment of the carburetor according to the present invention, which has many analogies with the carburetor shown in FIG. 1. The emulsion chamber 15 is equipped with a fixed calibrated hole 33 for delivering the premixture to the duct 19, and another hole 34 for establishing a communication with the balancing chamber 35. The chamber 35 has a calibrated hole 36 which puts it in communication with the duct 10, and a port 37 which puts it in communication with the duct 19; the cross-sectional area of the port 37 can be varied by acting on the screw 38 which, in this case, permits alone to adjust the idling RPM of the engine. As a matter of fact, by increasing the cross-sectional area of the port 37 the pressure in the chamber 38 is decreased and thus also in the chamber 15 which communicates therewith through the passageway 34, the result being thus that the more air is drawn through the port 37 the more petrol is drawn through the jet 16 and the petrol contents in the premixture delivered to the duct 19 is kept substantially constant. This particular idling adjustment system is better shown in the U.S. Pat. Application No. 361,031 filed on the 17th May, 1973 in the name of the same Applicant, now U.S. Pat. No. 3,878,271.

The advantageous system for adjusting the idling, as obtained by manipulating only the regulation screw of the induction of air, as indicated in the patent application cited above, can also be adopted in a carburetor according to the invention which has the emulsion chamber of the idling premixture separated from the emulsion chamber for the progression premixture according to what has been shown in FIG. 2. An exemplary practical embodiment is diagrammatically shown in FIG. 4 showing a carburetor in which there have been indicated with the same reference numerals the parts similar to those of the carburetors as described above. The chamber 22 communicates with the duct 19 through calibrated ports 24, and the chamber 29 communicates with the duct 19 through calibrated ports 39. The chamber 29, through the calibrated port 40, communicates with the chamber 35 which, in turn, is connected to the duct 10 by the port 36 and to the duct 19 by the adjustable cross-section port 37.

To simplify the disclosure and the drawings, the several embodiments shown of a carburetor according to the invention have been illustrated as feeding a single cylinder of an internal combustion engine. This arrangement will be found in general when in a multi-cylinder engine there are as many carburetor bodies and as many throttling butterflies in the intake ducts as there are cylinders.

In the case in which it is preferred to feed many cylinders simultaneously with a single carburetor, there will be provided a number of emulsion pre-chambers (indicated at 15 in FIGS. 1 and 3 and at 22 in FIGS. 2 and 4), each feeding a duct 19 which opens in the vicinity of the induction valve of the respective cylinder.

What we claim is:

1. An internal combustion engine, in which the air-fuel mixture is produced in a carburetor and introduced through an intake duct to each induction valve opening into each explosion chamber, said carburetor comprising at least a passage port for the feeding fluid; a butterfly throttling valve for controlling said passage port for the feeding fluid; at least a first premixing chamber communicating through calibrated ports with a fuel induction duct and with a cavity, said cavity communicating with the atmosphere through a calibrated port and with the intake duct through at least a progression passageway, said progression passageway opening in the vicinity of the edge of said throttle, so as to be upstream of the edge when the throttle is in its minimum opening position, and downstream of the edge when the throttle is partially open, said premixing chamber being connected by an auxiliary duct to said intake duct downstream of said carburetor, said first premixing chamber being connected to said auxiliary duct through a restricted passageway, and including further a compensation chamber communicating through calibrated ports with said first chamber, with the atmosphere and with said auxiliary duct downstream of the restricted passageway.

2. An engine according to claim 1, including adjustment means to vary the cross-sectional area of the communication port between said compensation chamber and said auxiliary duct.

* * * * *